US009428351B2

(12) United States Patent
Kawamura

(10) Patent No.: US 9,428,351 B2
(45) Date of Patent: Aug. 30, 2016

(54) FEEDING DEVICE, FEEDING CASSETTE, AND IMAGE FORMING APPARATUS

(71) Applicant: CANON KABUSHIKI KAISHA, Tokyo (JP)

(72) Inventor: Koji Kawamura, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/262,544

(22) Filed: Apr. 25, 2014

(65) Prior Publication Data

US 2014/0319757 A1 Oct. 30, 2014

(30) Foreign Application Priority Data

Apr. 30, 2013 (JP) ..... 2013-096014

(51) Int. Cl.
*B65H 1/26* (2006.01)

(52) U.S. Cl.
CPC ..... *B65H 1/266* (2013.01); *B65H 2403/411* (2013.01); *B65H 2403/5331* (2013.01); *B65H 2405/11425* (2013.01); *B65H 2405/121* (2013.01); *B65H 2511/12* (2013.01); *B65H 2511/22* (2013.01); *B65H 2601/1231* (2013.01)

(58) Field of Classification Search
CPC ..... B65H 1/266; B65H 2511/12; B65H 2511/22; B65H 2405/11425; B65H 2405/121; B65H 2601/1231
USPC ..... 271/171, 240
See application file for complete search history.

(56) References Cited

U.S. PATENT DOCUMENTS

| | | | | |
|---|---|---|---|---|
| 7,607,657 | B2 * | 10/2009 | Kawarago | 271/171 |
| 7,694,958 | B2 * | 4/2010 | Nakamura | 271/171 |
| 7,922,171 | B2 * | 4/2011 | Kawamura et al. | 271/171 |
| 8,186,671 | B2 * | 5/2012 | Nishiyama | 271/171 |
| 8,286,962 | B2 * | 10/2012 | Tanaka | 271/171 |
| RE44,947 | E * | 6/2014 | Kawamura et al. | 271/171 |
| 2010/0270735 | A1 * | 10/2010 | Allwright et al. | 271/171 |
| 2011/0272879 | A1 * | 11/2011 | Ushiyama et al. | 271/227 |
| 2011/0285075 | A1 * | 11/2011 | Nakamura et al. | 271/109 |

FOREIGN PATENT DOCUMENTS

JP 2003-160239 A 6/2003

* cited by examiner

*Primary Examiner* — Patrick Cicchino
(74) *Attorney, Agent, or Firm* — Canon USA Inc. IP Division

(57) ABSTRACT

There is provided a feeding device for feeding a sheet in which, when a user operates a knob of a second regulating portion disposed on a front side to move the second regulating portion, locking of a first regulating portion disposed on a rear side can be released.

13 Claims, 11 Drawing Sheets

101
102
28a
28
30c
30
30b
20c
20
32
35b
34
34b
35
35
35
t
t
20d
32b
30d
u
u
35e
34d
35f
t = 0
34

FEEDING DEVICE, FEEDING CASSETTE, AND IMAGE FORMING APPARATUS

BACKGROUND OF THE INVENTION

1. Field of the Invention

The present invention relates to a feeding device, a feeding cassette, and an image forming apparatus.

2. Description of the Related Art

Recently, an image forming apparatus such as a copier, a printer, and a facsimile machine includes a feeding device for feeding a sheet and an image forming unit for forming an image on the sheet fed from the feeding device. Such a feeding device may include a feeding cassette that is detachable from the main body of the apparatus.

FIG. 11 is a diagram illustrating a configuration of a conventional feeding cassette 150. The feeding cassette 150 includes a sheet stacking tray 153. The sheet stacking tray 153 can be raised and lowered so that sheets S stacked on the sheet stacking tray 153 are pressed onto a feeding roller. The feeding cassette 150 further includes a trailing edge regulating plate (not illustrated). The trailing edge regulating plate can slide and regulate a position of an edge (hereinafter referred to as a trailing edge) of the sheets S stacked on the sheet stacking tray 153, on an upstream side in the feeding direction thereof. Thus, the feeding cassette 150 can accommodate the sheets S of different sizes. The feeding cassette 150 further includes a pair of side regulating portions 151 and 152. The side regulating portions 151 and 152 regulate positions of the side edges of the sheets S in a direction (hereinafter referred to as a width direction) perpendicular to the feeding direction. The pair of side regulating portions 151 and 152 is coupled with each other via a rack gear and a pinion gear (not illustrated). Thus, when the user moves one side regulating portion 151, the other side regulating portion 152 moves in conjunction with the side regulating portion 151.

Even the sheets S of a standard size such as A4 or B5 vary in outer dimensions. For example, when a dimensional tolerance in the width direction of the sheet S is ±2 mm, the side regulating portions 151 and 152 need to follow the size of the sheet S in the range of ±2 mm. Thus, conventionally, one side regulating portion 152 serves as a reference surface 152*a*, and a sheet pressing portion 154 of the other side regulating portion 151 presses the sheet S against the reference surface 152*a*. A distance y between the sheets S and the side regulating portion 152 is zeroed by appropriately setting the stroke of the sheet pressing portion 154 and the spring pressure of a spring 155. Thus, the variations in the outer dimensions of the sheets S can be accommodated to maintain the print accuracy on the side of the reference surface 152*a*.

When the feeding cassette 150 is installed in the main body of the apparatus, the sheets S are likely to be pushed by inertia in the direction in which the feeding cassette 150 is installed. Thus, if the installing direction of the feeding cassette 150 is the same as the width direction (the direction indicated by an arrow 150*a*) of the sheets S, and the side regulating portion 152 on the rear side in the installing direction serves as the reference surface 152*a* in the width direction, the sheets S naturally come closer to the side of the reference surface 152*a* during the installation of the feeding cassette 150, thereby reducing the distance y. Thus, the spring pressure of the sheet pressing portion 154 can be lower in a case where the side regulating portion 152 on the rear side is set as the reference surface side than in a case where the side regulating portion 151 on the front side is set as the reference surface side. Such a configuration can minimize the resistance applied by the sheet pressing portion 154 to the sheets S, whereby the sheets S can be stably fed.

When changing the positions of the side regulating portions 151 and 152, the side regulating portion 151 on the front side can be operated easier than the side regulating portion 152 on the rear side. Thus, in many image forming apparatuses, the side regulating portion 151 on the front side is used as an operation portion for the user.

Japanese Patent Application Laid-Open No. 2003-160239 discusses a feeding device having a configuration where, in a pair of side regulating members for regulating the edge portions of sheets stacked on a stacking tray, the one on the rear side is fixed (locked). In the feeding device discussed in Japanese Patent Application Laid-Open No. 2003-160239, the side regulating member on the rear side is fixed, and thus the side regulating member can be prevented from falling down due to the inertia produced when the feeding cassette is inserted in the main body of the apparatus. Japanese Patent Application Laid-Open No. 2003-160239 discusses a configuration where the side regulating member on the rear side is locked or unlocked by a user directly operating a lever used for locking and unlocking the member (first and second exemplary embodiments in Japanese Patent Application Laid-Open No. 2003-160239). Japanese Patent Application Laid-Open No. 2003-160239 further discusses a configuration where the user operates a knob of the side regulating member on the front side so that the side regulating member on the rear side is locked or unlocked (third and fourth exemplary embodiments in Japanese Patent Application Laid-Open No. 2003-160239).

However, the configurations discussed in Japanese Patent Application Laid-Open No. 2003-160239 needs to be further improved in the following points. First, the first and the second embodiments in Japanese Patent Application Laid-Open No. 2003-160239 need to be improved in usability because the user needs to directly operate the lever to lock or unlock the side regulating portion on the rear side. Next, the third and the fourth exemplary embodiments in Japanese Patent Application Laid-Open No. 2003-160239 require a plurality of dedicated parts for coupling the side regulating portion on the front side with the side regulating portion on the rear side. Thus, an increase in the number of parts may cause a cost increase. Furthermore, the added dedicated parts are disposed in a space below the side regulating members, whereby the size of the feeding cassette might increase in the height direction.

SUMMARY OF THE INVENTION

The present invention is directed to a feeding device and an image forming apparatus in which the movement of a positioning portion for regulating the position of a sheet can be regulated and the regulation can be released without impairing usability.

According to an aspect of the present invention, a feeding device for feeding a sheet includes a stacking portion on which the sheet is to be stacked, a first positioning portion, which is disposed movably in a first direction and a second direction opposite to the first direction and is in contact with an edge of the sheet stacked on the stacking portion, configured to regulate a position of the sheet, a second positioning portion, which is disposed movably in the first direction and the second direction and is in contact with an edge of the sheet stacked on the stacking portion, configured to regulate the position of the sheet, an interlocking portion configured to move the first positioning portion and the second positioning portion in conjunction with each other, a first regulating portion configured to regulate a movement of the first positioning portion, and a first release portion configured to release, when the second positioning portion is moved in the first direction or the second direction, the regulation of the movement of the first positioning portion performed by the first regulating portion.

Further features of the present invention will become apparent from the following description of exemplary embodiments with reference to the attached drawings.

DESCRIPTION OF THE EMBODIMENTS

Figure 1A:
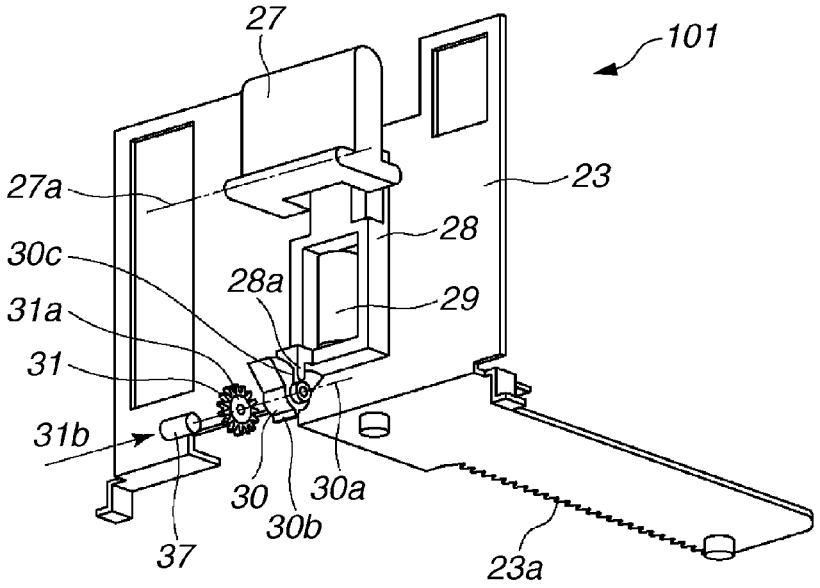
FIGS. 1A and 1B are diagrams illustrating configurations of first and second positioning portions according to a first exemplary embodiment.

Various exemplary embodiments, features, and aspects of the invention will be described in detail below with reference to the drawings. The same components are denoted by the same reference numerals in each figure.

Figure 7:
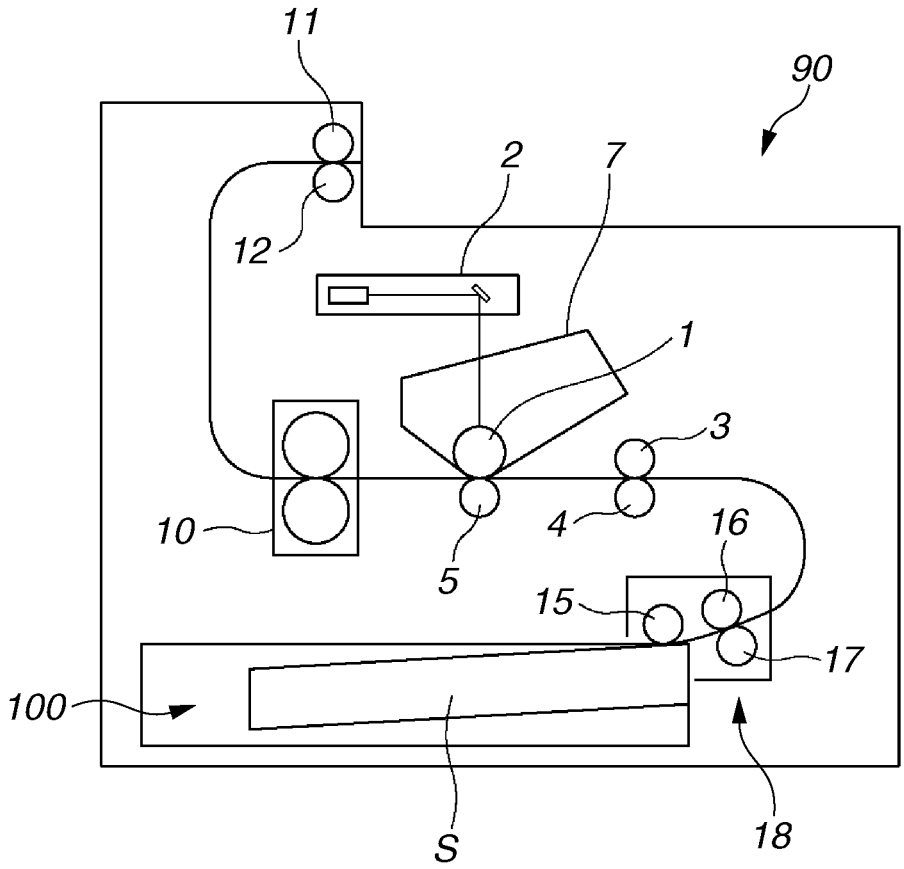
FIG. 7 is a cross-sectional view of a printer according to the first exemplary embodiment.

FIG. 7 is a cross-sectional view of an image forming apparatus including a feeding device according to a first exemplary embodiment of the present invention. A monochrome laser beam printer (hereinafter referred to as a printer) 90 serving as the image forming apparatus includes, in a cartridge 7, a photosensitive drum 1 serving as an image bearing member. An exposure unit 2 is disposed in the vicinity of the photosensitive drum 1. The exposure unit 2 irradiates the photosensitive drum 1 with a laser beam based on image information to form an image on the photosensitive drum 1. A transfer roller 5 for transferring a toner image on the photosensitive drum 1 onto a sheet constitutes a transfer unit together with the photosensitive drum 1.

In the first exemplary embodiment, the feeding device includes a feeding cassette 100 and a feeding roller unit (feeding unit) 18. The sheets S stored in the feeding cassette 100 are fed by a feeding roller 15 of the feeding roller unit 18. Then, the sheets S are conveyed one by one by a conveyance roller 16 and a separation roller 17.

The conveyed sheets S are further conveyed to the transfer unit by a pair of registration rollers 3 and 4. The transfer unit transfers the toner image onto a surface of the sheet S. The sheet S, onto which the toner image has been transferred, is conveyed to a fixing unit 10. The toner image on the sheet S is fixed on the sheet S by heat and pressure in the fixing unit 10. The sheet S, on which the toner image has been fixed, is discharged to a discharge portion by a pair of discharging rollers 11 and 12.

Figure 6:
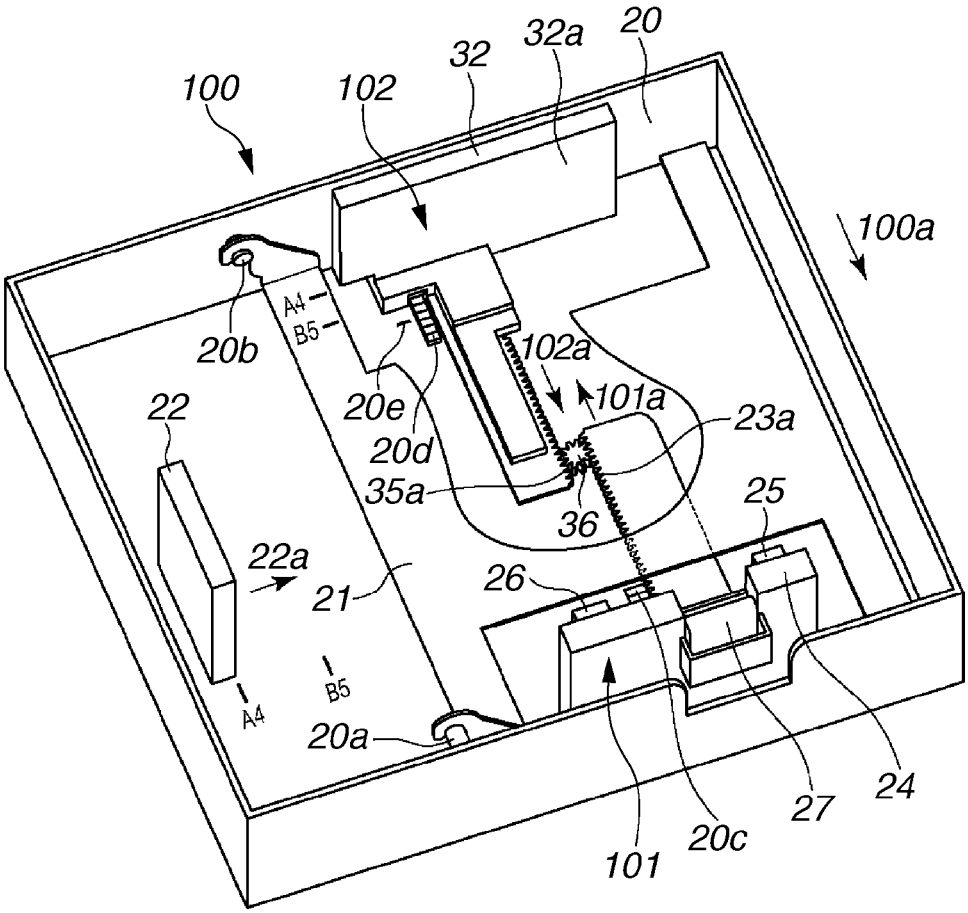
FIG. 6 is a perspective view of the feeding cassette according to the first exemplary embodiment.

Next, the configuration of the feeding cassette 100 according to the first exemplary embodiment will be described. FIG. 6 is a perspective view of the feeding cassette 100. The feeding cassette 100 can be pulled out from the printer 90 (see FIG. 7) in the width direction (in the direction indicated by an arrow 100*a*) perpendicular to the feeding direction.

A cassette frame member 20 forms a frame that allows the feeding cassette 100 to serve as a unit that can be pulled out from the printer 90. In the illustration in FIG. 6, a stacking plate 21 serving as a stacking portion, on which the sheets S are to be stacked, is partially cut out for the convenience of description. The stacking plate 21 is attached to the frame member 20, and is able to swing about supporting portions 20*a* and 20*b*. An urging member (not illustrated) causes the downstream side of the stacking plate 21 in the feeding direction to swing upward.

The trailing edge regulating plate 22 serving as a feeding direction positioning portion, which regulates a position of the sheets S in the feeding direction, comes into contact with the trailing edge of the sheets S stacked on the stacking plate 21, and thus regulates the position of the sheets S in the feeding direction. The trailing edge regulating plate 22 can slide in and opposite to the feeding direction (the direction indicated by an arrow 22*a*), so that sheets of different sizes can be accommodated.

The first side regulating portion 102 serving as the first positioning portion and the second side regulating portion 101 serving as the second positioning portion come into contact with the edge portions of the sheets S stacked on the stacking plate 21 to regulate the side edge positions of the sheets S in the width direction perpendicular to the feeding direction. The first side regulating portion 102 is disposed more on the rear side than the second side regulating portion 101 in the insertion direction of the feeding cassette 100. Conversely, the second side regulating portion 101 is disposed more on the front side than the first side regulating portion 102. The first and the second side regulating portions 102 and 101 can slide in an insertion direction (first direction) and a pullout direction (second direction) of the feeding cassette 100. The frame member 20 movably holds the first and the second side regulating portions 102 and 101.

The first and the second side regulating portions 102 and 101 are coupled with each other via a rack gear 23*a*, a pinion gear 36, and a rack gear 35*a*. When the user operates and moves the second side regulating portion 101 on the front side in the width direction 101*a*, the first side regulating portion 102 on the rear side moves in the direction 102*a* in conjunction with the second side regulating portion 101. When the user operates and moves the second side regulating portion 101 in the direction 102*a*, the first side regulating portion 102 moves in the direction 101*a* in conjunction with the second side regulating portion 101. More specifically, in the first exemplary embodiment, the rack gear 23*a* disposed in the second side regulating portion 101, the rack gear 35*a* disposed in the first side regulating portion 102, and the pinion gear 36 disposed in the cassette frame portion 20 constitute an interlocking portion for moving the first and the second side regulating portions 102 and 101 in conjunction with each other.

Figure 5A:
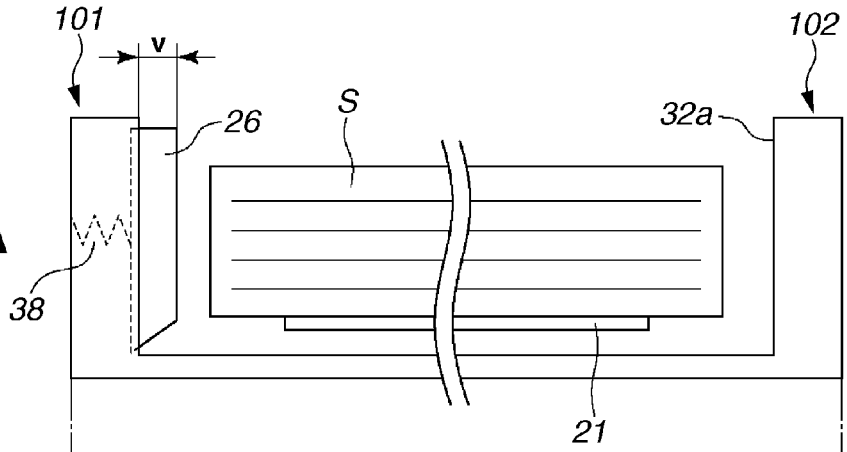
FIGS. 5A to 5C are diagrams illustrating operations for setting a sheet of a non-standard size in a feeding cassette.
Figure 5B:
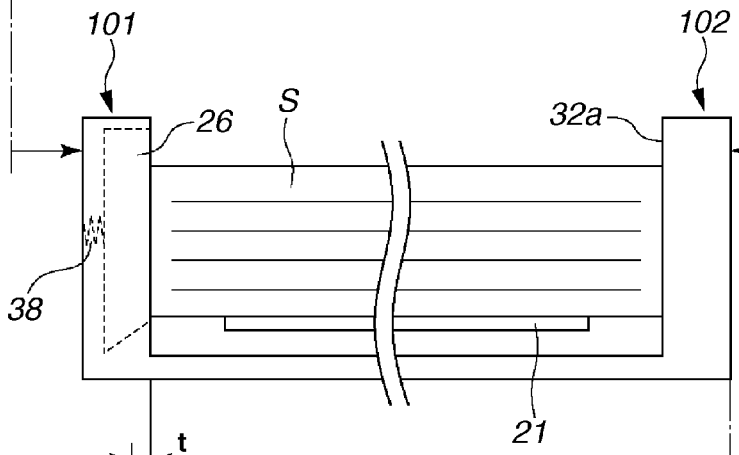
Figure 5C:
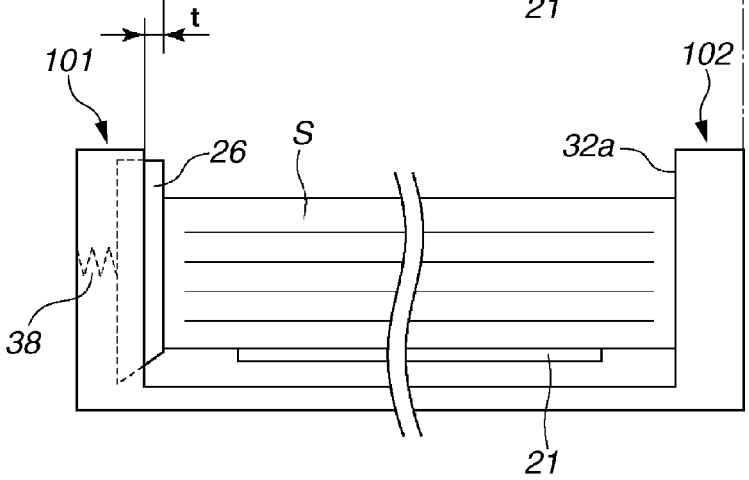

Sheet pressing members 25 and 26 disposed in the second side regulating portion 101 are pressured by a compression spring 38 (see FIGS. 5A to 5C). Thus, the sheet pressing members 25 and 26 press the edge portion of the sheets S so that the sheets S are pressed against a reference surface (contact portion) 32*a* of the first side regulating portion 102. In other words, the reference surface 32*a*, which the sheets S come into contact with, is disposed in the first side regulating portion 102.

Figure 1B:
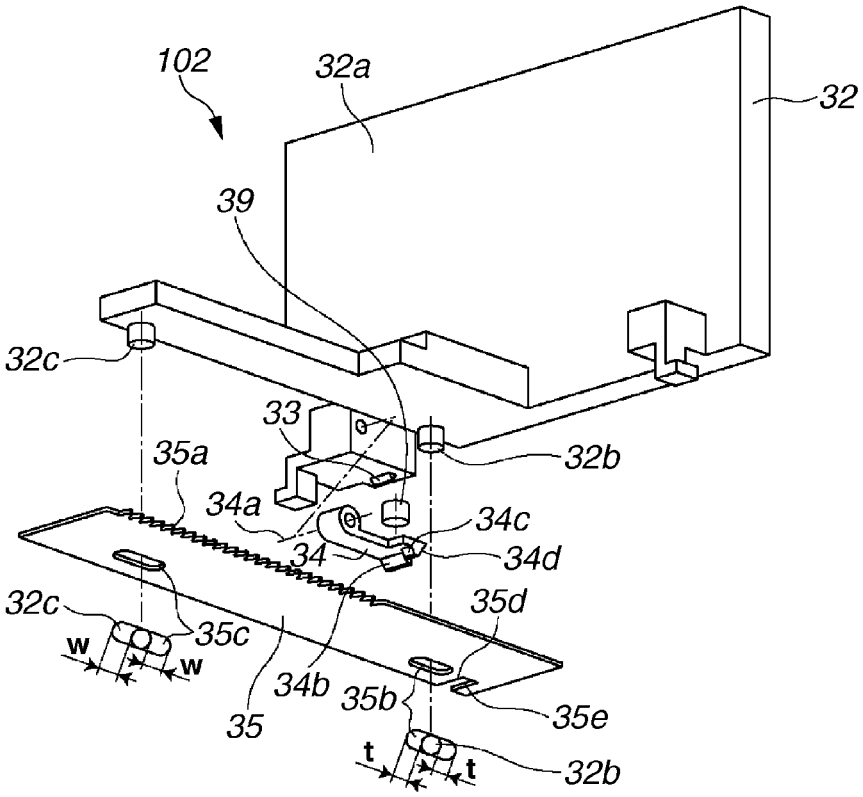

FIGS. 1A and 1B are each an exploded perspective view illustrating inner components of the pair of side regulating portions 101 and 102. FIGS. 1A and 1B respectively illustrate the second and the first side regulating portions 101 and 102.

First, the configuration of the second side regulating portion 101 will be described. In FIG. 1A, a second side regulating plate 23 is a component that forms the second side regulating portion 101 together with a second side regulating plate holder 24 (see FIG. 6). Inner components of the second side regulating portion 101 are held between the second side regulating plate 23 and the second side regulating plate holder 24. The rack gear 23*a* is formed in the second side regulating plate 23, and engages with the pinion gear 36 (see FIG. 6).

By operating (holding) a knob 27, the user can move the second side regulating portion 101. The knob 27 is held by the second side regulating plate holder 24, and is able to swing about a fulcrum 27*a*. A lever 28 is held by the second side regulating plate holder 24, and slides upward in conjunction with the operation of the knob 27. The lever 28 is pressured downward by a compression spring 29, and thus is in a lower position when the knob 27 is not operated.

A return gear 30 is held by the second side regulating plate holder 24, and is able to swing about a fulcrum 30*a*. The return gear 30 only has a single gear 30*b* engaging with the rack gear 20*c* (see FIGS. 6 and 2A to 2E) formed in the cassette frame member 20. When the lever 28 is in a lower position, a rib 28*a* of the lever 28 is in a groove 30*c* of the return gear 30.

A sliding gear 31 is held rotatably about the fulcrum 30*a*. The sliding gear 31 is pressured towards the return gear 30 (in the direction indicated by an arrow 31*b*) by a compression spring 37, and has a sliding surface 31*a* in contact with a surface (not illustrated) of the return gear 30. The sliding gear 31 engages with the rack gear 20*c* formed in the cassette frame member 20 (see FIGS. 6 and 2A to 2E).

Next, the configuration of the first side regulating portion 102 will be described. In FIG. 1B, the surface 32*a* of the first side regulating plate 32 serves as a reference surface of the sheets S in the width direction. A click member 33 is held by the first side regulating plate 32 and can slide in the vertical direction. The click member 33 is pressured downward by a spring (not illustrated). A click feeling is obtained when a distal end of the click member 33 sinks in (engages with) a click groove 20*e* formed in the cassette frame member 20 (see FIG. 6). The groove 20*e* (see FIG. 6) is formed at a position corresponding to a standard size of the sheet S such as A4 or B5.

The first side regulating plate 32 is provided with a locking member 34. The locking member 34 locks the first side regulating portion 102 to the cassette frame member 20. The locking member 34 is able to swing about a fulcrum 34*a*, and is pressured downward by a compression spring 39. A protrusion 34*b* is formed in the locking member 34. A protrusion 20*d* (engagement portion) is formed in the frame member 20. The protrusions 34*b* and 20*d* (see FIGS. 6 and 2A to 2E) engage with each other, whereby the first side regulating plate 32 is locked to the cassette frame member 20. In other words, the protrusion 34*b* of the locking member 34 and the protrusion 20*d* of the frame member 20 form a first regulating portion for regulating the movement of the first side regulating portion 102.

When the first side regulating plate 32 is locked, the first side regulating portion 102 is fixed. Thus, even when the user strongly inserts the feeding cassette 100 into the main body of the apparatus, the first side regulating portion 102 does not move. Thus, the first side regulating portion 102 can be accurately positioned, and misalignment of the sheets S can be prevented.

The locking by the locking member 34 is released by a lock release plate 35 that is connected to the first side regulating plate 32 and moves along with the movement of the second side regulating portion 101. Two oblong holes 35*b* and 35*c* are formed in the lock release plate 35. Bosses 32*b* and 32*c* of the first side regulating plate 32 are inserted in the oblong holes 35*b* and 35*c*, respectively. A distance t is set between the oblong hole 35*b* and the boss 32*b*, and a distance w longer than the distance t is set between the oblong hole 35*c* and the boss 32*c*. In such a configuration, when the lock release plate 35 moves in the width direction, the first side regulating plate 32 starts moving with a delay corresponding to the distance t. While the lock release plate 35 moves toward the first side regulating plate 32 to zero the distance t, an edge 35*d* or an edge 35*e* lifts an inclined surface (release surface) 34*c* or 34*d* of the locking member 34. Thus, the locking of the first side regulating portion 102 is released. In other words, the edges 35*d* and 35*e* form a first release portion for releasing the locking of the first side regulating portion 102.

The rack gear 35*a* is formed in the lock release plate 35, and engages with the pinion gear 36 (see FIG. 6).

Next, the operations of the first and the second side regulating portions 102 and 101 will be described. First, an operation of narrowing the distance between the first and the second side regulating plates 32 and 23 will be described. FIGS. 2A to 2E are cross-sectional views illustrating operations of the first and the second side regulating portions 102 and 101, in a case where the user moves the second side regulating portion 101 in the insertion direction of the feeding cassette 100 (the direction 101*a* in FIG. 6). In FIGS. 2A to 2E, only the portions necessary for the description are illustrated.

Figures 2A, 2B, 2C, 2D, 2E:
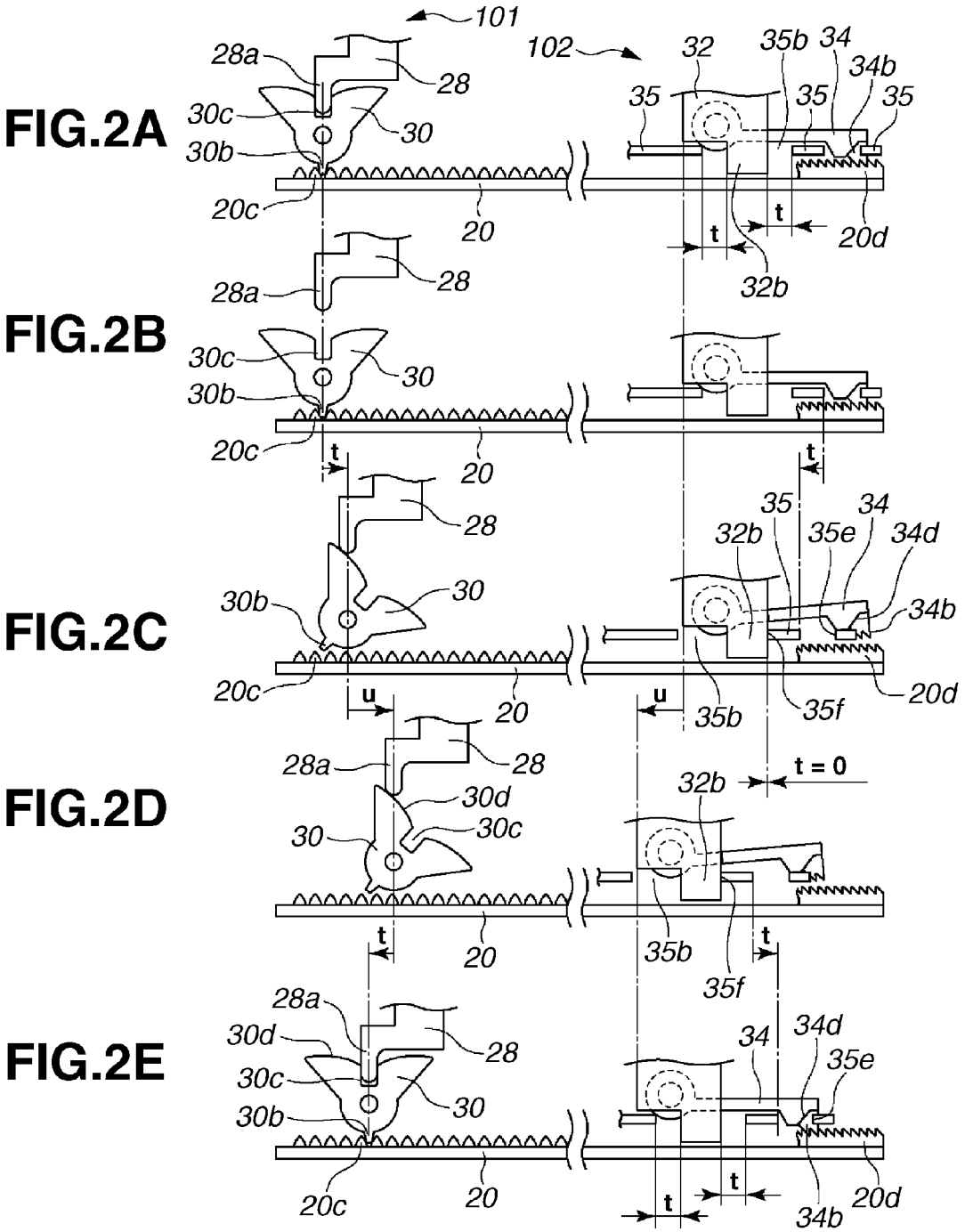
FIGS. 2A to 2E are diagrams illustrating operations according to the first exemplary embodiment.

FIG. 2A illustrates the state of the first and the second side regulating portions 102 and 101 before the user starts the operation. The lever 28 is lowered by the compression spring 29 (see FIGS. 1A and 1B). Thus, the rib 28*a* of the lever 28 is in the groove 30*c*. The gear 30*b* of the return gear 30 engages with the rack gear 20*c* of the cassette frame member 20. In this positional relationship, the second side regulating portion 101 is locked to the cassette frame member 20, and thus cannot slide. The protrusion 34*b* of the locking member 34 engages with the protrusion 20*d* formed in the cassette frame member 20. Thus, the first side regulating portion 102 is locked to the cassette frame member 20, and thus cannot slide. In other words, before the user performs the operation, the first and the second side regulating portions 102 and 101 are locked to the cassette frame member 20 and thus cannot slide. There is clearance corresponding to the distance t between the boss 32*b* of the first side regulating plate 32 and each end of the oblong hole 35*b* of the lock release plate 35.

FIG. 2B illustrates the state of the first and the second side regulating portions 102 and 101, in a case where the user holds the knob 27 (see FIGS. 1A and 1B). The lever 28 is raised by the knob 27, and thus the rib 28*a* of the lever 28 is pulled out of the groove 30*c* of the return gear 30. The knob operation releases the locking of the second side regulating plate portion 101. Meanwhile, the first side regulating portion 102 is in the same state as in FIG. 1A, that is, locked to the cassette frame member 20.

FIG. 2C illustrates the state of the first and the second side regulating portions 102 and 101, in a case where the user holding the knob 27 (see FIGS. 1A and 1B) moves the second side regulating portion 101 in the right direction in FIG. 2C (in the direction 101*a* in FIG. 6) by the distance t. In this state, the return gear 30 swings in the clockwise direction, and thus the gear 30*b* of the return gear 30 does not engage with the rack gear 20*c*. At the same time, the lock release plate 35 coupled to the second side regulating portion 101 via the pinion gear 36 (see FIG. 6) moves in the left direction in FIG. 2C (in the direction 102*a* in FIG. 6) by the distance t. The edge 35*e* of the lock release plate 35 raises the cam surface 34*d* of the locking member 34, and thus the protrusion 34*b* of the locking member 34 is disengaged from the protrusion 20*d* of the cassette frame member 20. Thus, the locking of the first side regulating portion 102 is released. The lock release plate 35 moves by the distance t, whereby the edge 35*f* of the oblong hole 35*b* of the lock release member 35 comes into contact with the boss 32*b* of the reference plate 32 on the rear side. As a result, the distance t between the oblong hole 35*b* and the boss 32*b* is zeroed.

FIG. 2D illustrates the state of the first and the second side regulating portions 102 and 101, in a case where the user further moves the second side regulating portion 101 in the right direction from the state in FIG. 2C, by a distance u. The edge 35*f* of the oblong hole 35*b* of the lock release member 35 is in contact with the boss 32*b* of the first side regulating plate 32, and thus the lock release plate 35 and the first side regulating plate 32 move to the left side by the distance u.

FIG. 2E illustrates the state of the first and the second side regulating portions 102 and 101, in a case where the user releases the knob 27 in the state in FIG. 2D. When the user releases the knob 27, the lever 28 is lowered by the spring force of the compression spring 29 (see FIGS. 1A and 1B). Then, the rib 28*a* of the lever 28 pushes the cam surface 30*d* of the return gear 30. The return gear 30 swings in the anticlockwise direction until the rib 28*a* enters into the groove 30*c*. When the return gear 30 swings in the anticlockwise direction, the gear 30*b* of the return gear 30 engages with the rack gear 20*c* of the cassette frame member 20, and the second side regulating portion 101 moves to the left side by the distance t. At the same time, the lock release plate 35 moves in the right direction by the distance t. Thus, the edge 35*e* of the lock release plate 35 moves away from the cam surface 34*d* of the locking member 34, and the protrusion 34*b* of the locking member 34 engages with the protrusion 20*d* of the cassette frame member 20. Thus, the first and the second side regulating portions 102 and 101 are locked to the cassette frame member 20, whereby the operation performed by the user to narrow the first and second side regulating plates 32 and 23 is completed.

As described above, in the first exemplary embodiment, when the user operates the knob 27 to move the second side regulating portion 101 in a direction that narrows the distance to the first side regulating portion 102, and then releases the knob 27, the second side regulating portion 101 moves in a direction that widens the distance to the first side regulating portion 102 (a direction opposite to the direction in which the user has moved the second side regulating portion 101). In other words, the return gear 30 and the rib 28*a* form a movement portion for moving the second side regulating portion 101, which has been moved in the installing direction of the feeding cassette 100, in the pullout direction of the feeding cassette 100. On the other hand, the first side regulating portion 102 disposed on the rear side in the insertion direction of the feeding cassette 100 does not move. Thus, even when the user strongly inserts the feeding cassette 100 into the main body of the apparatus, the sheets S can be prevented from being misaligned.

Figure 3:
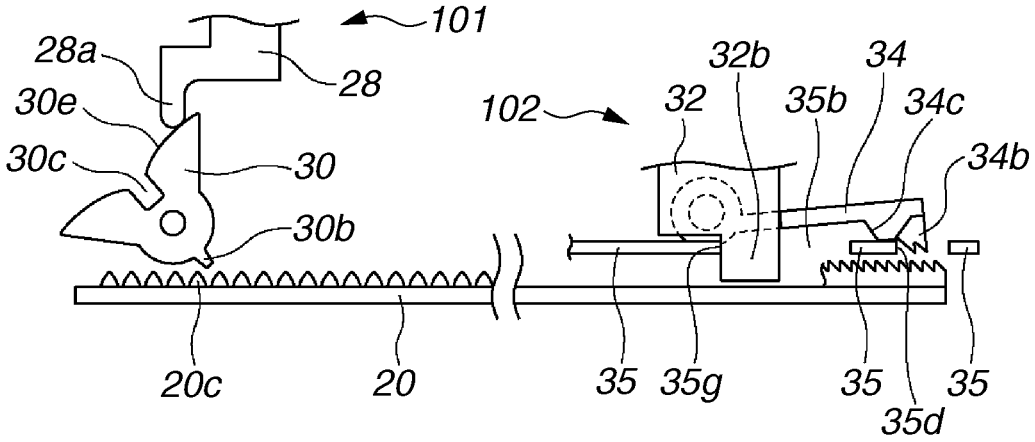
FIG. 3 is a diagram illustrating an operation according to the first exemplary embodiment.

Next, the operation performed by the user to widen the distance between the first and the second side regulating plates 32 and 23 will be described with reference to FIG. 3. FIG. 3 is a cross-sectional view illustrating operations of the first and the second side regulating portions 102 and 101 in a case where the user moves the second side regulating portion 101 in the pullout direction of the cassette 100 (the direction 102*a* in FIG. 6). In FIG. 3, only the portions necessary for the description are illustrated.

The operations of the components for widening the distance between the first and the second side regulating plates 32 and 23 are different from the operations of the components for narrowing the distance between the first and the second side regulating plates 32 and 23, only in the operation direction. Thus, FIG. 3 illustrates only a diagram corresponding to FIG. 2D.

When the user 27 holds the knob 27 (see FIGS. 1A and 1B) to move the second side regulating portion 101 in the left direction in FIG. 3, the return gear 30 swings in the anticlockwise direction. At the same time, the lock release plate 35 moves in the right direction so that the edge 35*d* of the lock release plate 35 raises the cam surface 34*c* of the locking member 34. Thus, the locking of the first side regulating plate 32 is released. Then, the edge 35*g* of the oblong hole 35*b* comes into contact with the boss 32*b* of the reference plate 32 on the rear side, causing the first side regulating plate 32 to move in the right direction. When the user releases the knob 27 (see FIGS. 1A and 1B) after moving the first side regulating plate 32 to a desired position, the rib 28*a* of the lever 28 pushes a cam surface 30*e* of the return gear 30. Thus, the return gear 30 swings in the clockwise direction, whereby the second side regulating portion 101 moves to the right side by the distance t. At the same time, the lock release plate 35 moves in the left direction by the distance t. Thus, the movement operation of widening the distance between the first and the second side regulating plates 32 and 23 is completed.

As described above, the distance between the first and the second side regulating plates 32 and 23 can be changed according to the size of the sheets S to be used.

Figure 4A:
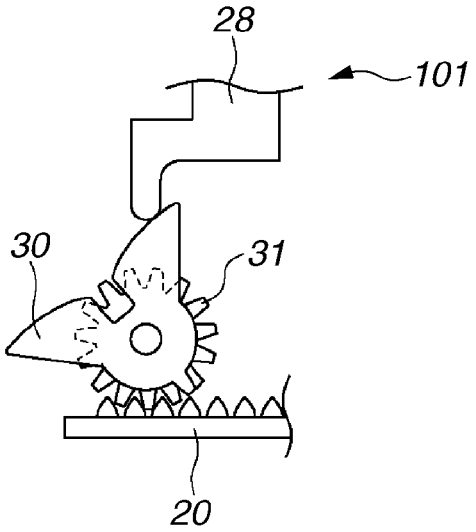
FIGS. 4A and 4B are diagrams illustrating operations according to the first exemplary embodiment.
Figure 4B:
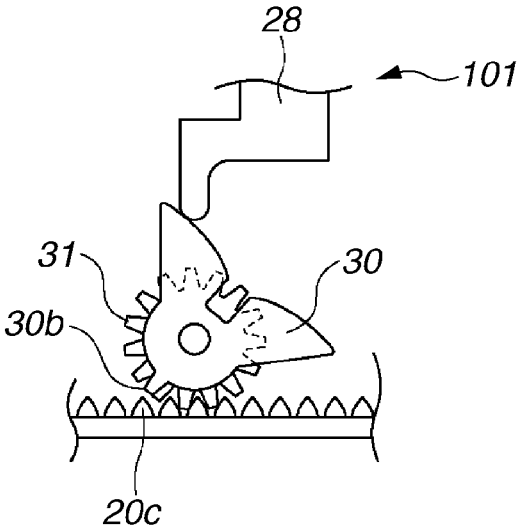

Next, an operation of moving the second side regulating plate 23 back and forth, performed by the user holding the operation knob 27 (see FIGS. 1A and 1B), will be described with reference to FIGS. 4A and 4B. FIGS. 4A and 4B are cross-sectional views illustrating the inner components of the second side regulating portion 101. Only the portions necessary for the description are illustrated in FIGS. 4A and 4B.

FIG. 4B illustrates the state of the second side regulating portion 101 in a case where the user holding the knob 27 moves the second side regulating portion 101 in the right direction and stops the movement. At this time, the return gear 30 swings in the clockwise direction.

Next, when the user holding the knob 27 moves the second side regulating portion 101 in the left direction, the sliding gear 31 engaging with the rack gear 23*a* rotates in the anticlockwise direction. As described above, the sliding gear 31 has the sliding surface 31*a* (see FIGS. 1A and 1B) pushed against a surface (not illustrated) of the return gear 30. Thus, when the sliding gear 31 rotates in the anticlockwise direction, the return gear 30 swings in the anticlockwise direction due to the sliding resistance of the slide surface 31*a*. Thus, the gear 30*b* of the return gear 30 can engage with the rack gear 20*c* of the cassette frame member 20. Then, when the second side regulating portion 101 is further moved in the left direction, the state of the second side regulating portion 101 illustrated in FIG. 4A is achieved.

If the sliding gear 31 is not provided, when the user holding the knob 27 changes the direction of the second side regulating portion 101, the gear 30*b* of the return gear 30 cannot engage with the rack gear 20*c*, thereby causing a malfunction to occur. The sliding gear 31 is provided to prevent such a malfunction from occurring.

Next, a procedure for the user to set the sheets S in the feeding cassette 100 will be described. Here, a procedure of setting the sheets S of the A4 size in the feeding cassette 100 will be described with reference to FIG. 6. A procedure recommended to the user is that the first and the second side regulating portions 102 and 101 and the trailing edge regulating plate 22 area set at positions corresponding to the A4 size, and then the sheets S are set in the feeding cassette 100.

First, the user moves the second side regulating portion 101 so that the reference surface 32*a* of the first side regulating plate 32 is set at the position corresponding to the A4 size, engraved in the stacking plate 21. When the reference surface 32*a* is moved to the position corresponding to the A4 size, the user can recognize that the first side regulating plate 32 is precisely set at the position corresponding to the A4 size, from the click feeling produced by the click member 33 (see FIGS. 1A and 1B). When the user stops the second side regulating portion 101 at the position, the second side regulating portion 101 is also set at the position corresponding to the A4 size.

Similarly, the user sets the trailing edge regulating plate 22 at the position corresponding to the A4 size. Then, the user stacks the sheets S of the A4 size on the stacking plate 21. By the user setting the sheets S in the feeding cassette 100 through the procedure described above, an edge portion of the sheets S on the rear side can be set at the proper position, regardless of the variations in the outer dimensions of the sheets S in the width direction.

Next, a procedure of setting the sheets S of a non-standard size in the feeding cassette 100 will be described with reference to FIGS. 5A to 5C. The sheets of non-standard size are sheets of a size different from the standard size such as A4 or B5. A description of the trailing edge regulating plate 22 will be omitted here.

First, as illustrated in FIG. 5A, the user widens the distance between the pressing member 26 of the second side regulating portion 101 and the reference surface 32*a* of the first side regulating plate 32, to make it larger than the size of the sheets S of the non-standard size. Then, the user places the sheets S of the non-standard size on the stacking plate 21.

Next, as illustrated in FIG. 5B, the user narrows the distance between the first and the second side regulating plates 101 and 102, so that the sheets S of the non-standard size are held between the pressing member 26 and the reference surface 32*a*. When the user releases the knob 27, the second side regulating portion 101 returns to the left side by the distance t and then stops as illustrated in FIG. 5C.

In the first exemplary embodiment, a movable distance v of the pressing member 26 is larger than the distance t. Thus, even when the second side regulating portion 101 returns by the distance t, the pressing member 26 can press the sheets S against the reference surface 32*a* of the first side regulating portion 102.

The sheets S of the standard size may be set in the same procedure as that for the sheets S of the non-standard size. However, the position of the edge portion of the sheets S on the rear side may slightly deviate from the proper position due to, for example, variations in outer shape sizes of the sheets S. Thus, the recommended procedure is that the first and the second side regulating portions 102 and 101 and the trailing edge regulating plate 22 are positioned and then, the sheets S of the standard size are set.

In the present exemplary embodiment, not only the first side regulating portion 102 on the rear side, but also the second side regulating portion 101 on the front side is locked. This can prevent the first and the second side regulating portions 102 and 101 from being moved during the time between when the pair of side regulating portions 101 and 102 are positioned and when the sheets S are set and the feeding cassette 100 is inserted in the printer 90. That is, the sheets S can be prevented from being misaligned Further, in the first exemplary embodiment, the user can lock or unlock the first side regulating portion 102 on the rear side by operating the knob 27 of the second side regulating portion 101 on the front side to move the second side regulating portion 101. Thus, the user does not need to directly operate the first side regulating portion 102 on the rear side, whereby high usability is achieved.

Next, a second exemplary embodiment of the present invention will be described. A description of a configuration and an operation in the second exemplary embodiment that are similar to those in the first exemplary embodiment will be omitted as appropriate.

Figure 8:
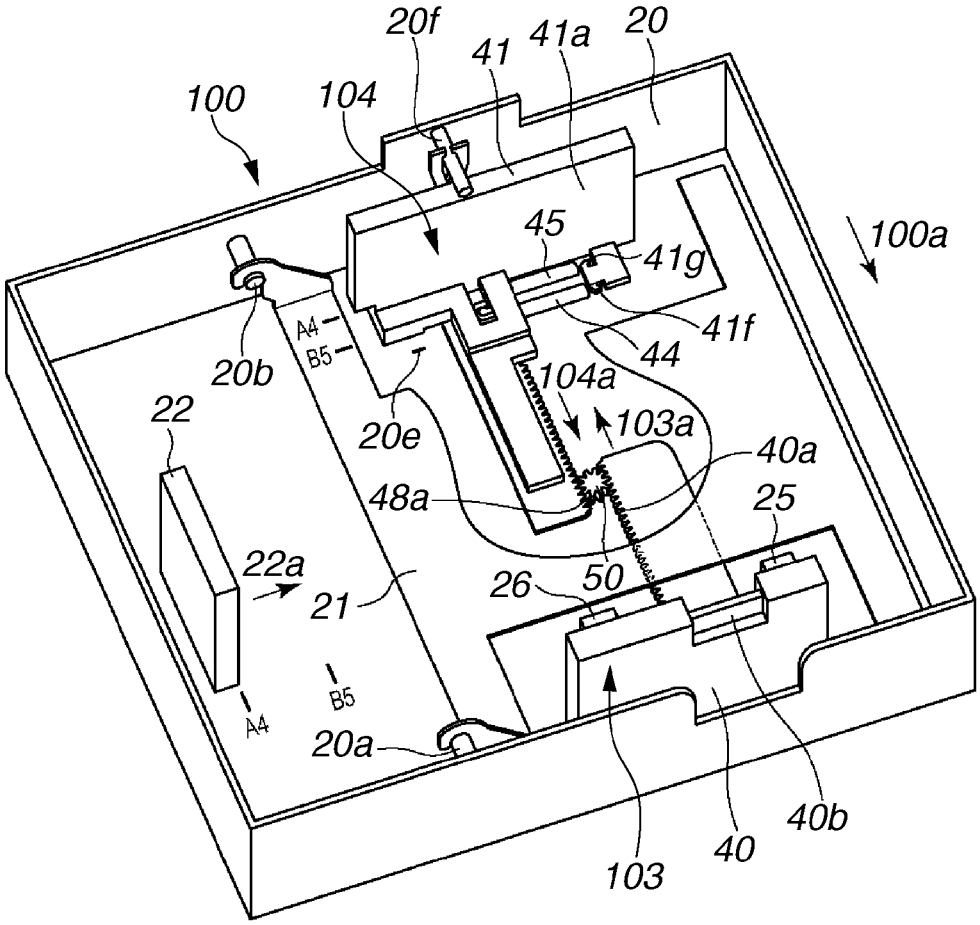
FIG. 8 is a perspective view of a feeding cassette according to a second exemplary embodiment.

FIG. 8 is a perspective view of the feeding cassette 100 according to the second exemplary embodiment. The feeding cassette 100 can be pulled out from the printer (see FIG. 7) in the width direction (the direction indicated by the arrow 100*a*) perpendicular to the feeding direction.

First and second side regulating portions 104 and 103 regulate the positions of the side edges of the sheets S in the width direction. The first and second side regulating portions 104 and 103 are coupled with each other via a rack gear 40*a*, a pinion gear 50, and a rack gear 48*a*. Thus, when an operation portion 40*b* of the second side regulating portion 103 is moved in the width direction (the direction 103*a*), the first side regulating portion 104 moves in the width direction (the direction 104*a*) in conjunction with the second side regulating portion 103. The operation portion 40*b* of the second side regulating portion 103 is integrally formed with the second side regulating plate 40. A boss 20*f*, in which grooves of male screw shape are formed, is disposed on a rear-side wall surface of the cassette frame member 20.

Figure 9:
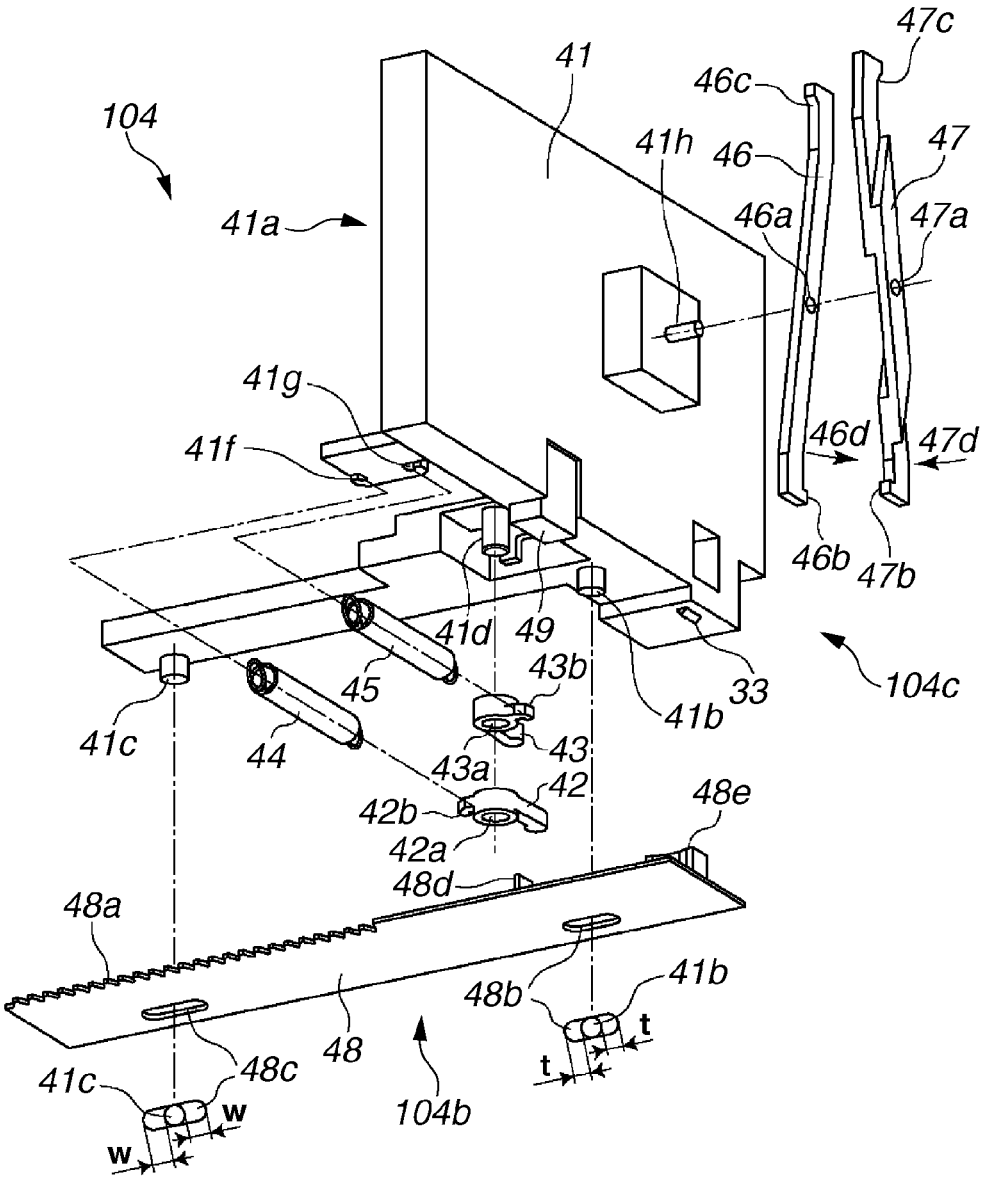
FIG. 9 is a diagram illustrating configurations of first and second positioning portions according to the second exemplary embodiment.

FIG. 9 is an exploded perspective view illustrating inner components of the first side regulating portion 104. A reference surface 41*a* of the first side regulating plate 41 serves as a reference of the position of the sheets S in the width direction.

A first return lever 42 is held to be capable of swinging about a fulcrum 42*a*. A second return lever 43 is held to be capable of swinging about a fulcrum 43*a*. A boss 41*d* disposed below the first side regulating plate 41 is inserted into the first and the second levers 42 and 43. Tension springs 44 and 45 are respectively hooked on spring hook portions 42*b* and 43*b*. Hooks of the tension springs 44 and 45 on the opposite side are hooked on spring hook portions 41*f* and 41*g* of the first side regulating plate 41.

A pair of lock arms 46 and 47 locks the first side regulating plate 41 to the cassette frame member 20. A boss 41*h* is inserted in the first and the second lock arms 46 and 47. The first lock arm 46 can swing about a fulcrum 46*a*. The second lock arm 47 can swing about a fulcrum 47*a*. The pair of lock arms 46 and 47 is respectively pressured in the directions indicated by arrows 46*d* and 47*d* by springs (not illustrated). Grooves 46*c* and 47*c* of female screw shape are respectively formed in the pair of lock arms 46 and 47. The grooves 46*c* and 47*c* of female screw shape engage with the boss 20*f* (see FIG. 8) of male screw shape on the cassette frame member 20. Thus, the first side regulating plate 41 is locked to the cassette frame member 20.

A lock release plate 48 releases the locking of the pair of lock arms 46 and 47. Bosses 41*b* and 41*c* of the first side regulating plate 41 are respectively inserted in two oblong holes 48*b* and 48*c* formed in the lock release plate 48. The distance t is set between the oblong hole 48*b* and the boss 41*b*. In such a configuration, when the lock release plate 48 moves in the width direction, the first side regulating plate 41 starts moving with a delay corresponding to the distance t.

The lock release plate 48 is provided with a cam surface 48*e*. The cam surface 48*e* pushes out a surface 46*b* of the first lock arm 46 and a surface 47*b* of the second lock arm 47, whereby the locking is released.

A brake portion 49 provides resistance to the movement of the first side regulating plate 41. The brake portion 49 is in contact with a surface of the cassette frame member 20.

<Operation of Side Regulating Plate>

Figure 10A:
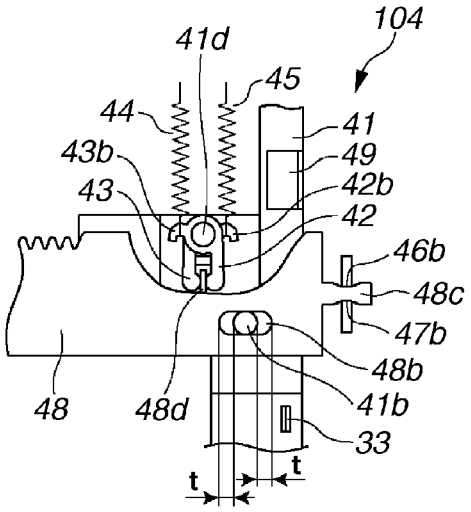
FIGS. 10A to 10D are diagrams illustrating operations according to the second exemplary embodiment.
Figure 10B:
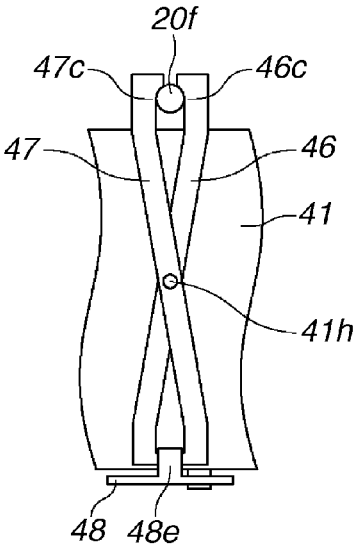
Figure 10C:
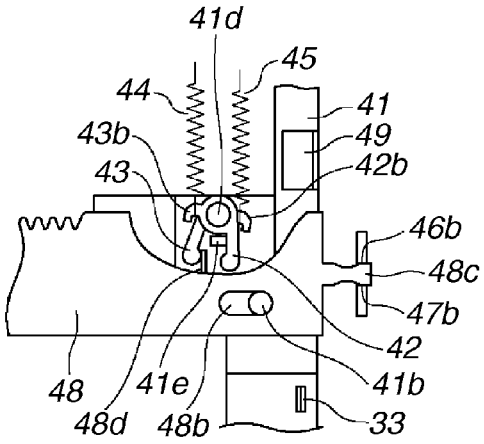
Figure 10D:
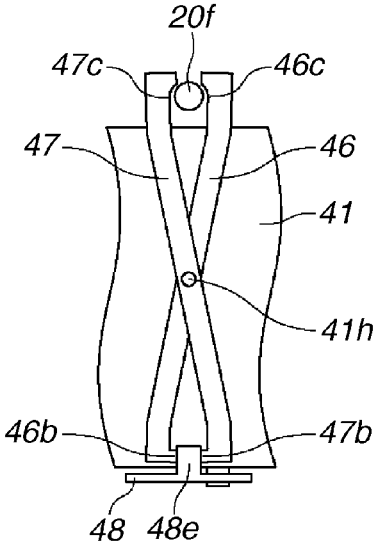
Figure 11:
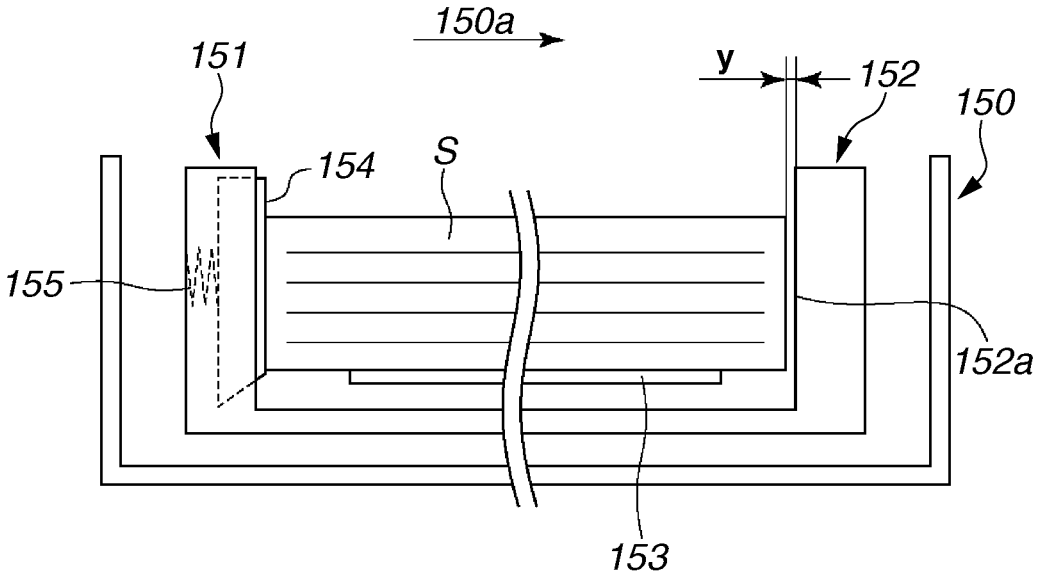
FIG. 11 is a diagram illustrating a configuration of a conventional feeding cassette.

Next, an operation of the side regulating plates 41 and 40 as a feature of the second exemplary embodiment will be described with reference to FIGS. 10A to 10D. FIGS. 10A and 10C are diagrams viewing from below (the direction indicated by an arrow 104*b* in FIG. 9) the side regulating portion 104 on the rear side. FIGS. 10B and 10D are diagrams viewing from the back (the direction indicated by an arrow 104*c* in FIG. 9) the side regulating portion 104 on the rear side.

FIGS. 10A and 10B illustrate the state of the first side regulating portion 104 before the user performs the operation. The grooves 46*c* and 47*c* of female screw shape in the pair of lock arms 46 and 47 engage with the boss 20*f* of male screw shape on the cassette frame member 20. Thus, the first side regulating portion 104 is locked to the cassette frame member 20, and thus cannot slide.

FIGS. 10C and 10D illustrate the state of the first side regulating portion 104 in a case where the user operates the operation portion 40*b* (see FIG. 8) to move the second side regulating portion 103 by the distance t in a direction in which the distance to the first side regulating portion 104 becomes narrower. Here, the lock release plate 48 moves in the left direction in FIG. 10C by the distance t.

When the lock release plate 48 moves, the second return lever 43 is pushed by the rib 48*d* of the lock release plate 48 to swing. The first return lever 42 is in contact with the rib 41*e* of the first side regulating plate 41, and thus does not swing. At the same time, the cam surface 48*e* of the lock release plate 48 pushes out the surface 46*b* of the first lock arm 46 and the surface 47*b* of the second lock arm 47. Thus, the grooves 46*c* and 47*c* of female screw shape are disengaged from the boss 20*f* of male screw shape on the cassette frame member 20.

Then, the user moves the first side regulating plate 41 to a predetermined position and releases the operation portion 40*b* (see FIG. 8). Thus, the lock release plate 48 is returned to the right by the distance t, by the spring force of the spring 45. Then, the states illustrated in FIGS. 10A and 10B where the first side regulating portion 104 is locked are achieved, whereby the operation of narrowing the distance between the side regulating plates 41 and 40 is completed.

If the resistance applied by the brake portion 49 to the side regulating plate 41 is set to be larger than the force applied by the springs 44 and 45 to return the lock release plate 48, a smooth operation can be achieved.

According to the second exemplary embodiment, the number of parts can be reduced, and cost reduction can be achieved. Since the upper position of the first side regulating portion 104 can be locked, the reference surface 41*a* of the first side regulating plate 41 is less likely to fall down due to the impact produced when the user strongly inserts the cassette.

In the above-described exemplary embodiments, as an example of the image forming unit for forming an image on a sheet, an electrophotograpic image forming process is used. The present invention is not limited to the unit using the electrophotograpic image forming process. For example, the image forming unit for forming an image on a sheet may use an inkjet image forming process that forms an image on a sheet by ejecting ink from a nozzle.

The configurations where the first and the second exemplary embodiments are applied to a cassette for feeding a sheet have been described above. However, the present invention is not limited thereto. For example, the exemplary embodiments of the present invention may be applied to a document reading device for reading a document, a feeding device, or a manual feeding device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-096014 filed Apr. 30, 2013, which is hereby incorporated by reference herein in its entirety.

What is claimed is:

1. A feeding device configured to feed a sheet, the feeding device comprising:

a feeding cassette capable of being inserted into and pulled out from a main body of an apparatus, wherein the feeding cassette includes:

a stacking portion on which the sheet is stacked;

a first positioning unit provided movably in a first direction and a second direction opposite to the first direction and configured to regulate a position of the sheet stacked on the stacking portion, the first positioning unit has a first side regulating member and an engaging member, the first side regulating member including a first abutting portion configured to contact with an edge of the sheet, the engaging member including an engaging portion configured to engage with the first side regulating member, the engaging member and the first side regulating member move integrally in a state that the engaging portion engages with the first side regulating member and the engaging member moves with respect to the first side regulating member in a state that the engaging portion does not engage with the first side regulating member;

a second positioning unit provided movably in the first direction and the second direction and configured to regulate the position of the sheet stacked on the stacking portion;

a frame member configured to movably hold the first positioning unit and the second positioning unit;

a locking member configured to lock a movement of the first side regulating member with respect to the frame member, a lock of the first side regulating member locked by the locking member being released by the engaging member moving with respect to the first side regulating member; and an interlocking unit configured to move the engaging member and the second positioning unit in conjunction with each other, wherein the locking member is provided on the first side regulating member, and wherein the first regulating member includes a lock engagement portion provided on the frame member, the locking member being movable between a lock position where the locking member engages with the lock engagement portion and a release position where the locking member does not engages with the lock engagement portion.

2. The feeding device according to claim 1, wherein the first positioning unit is disposed more on a rear side than the second positioning unit in an insertion direction of the feeding cassette.

3. The feeding device according to claim 2, wherein the second positioning unit includes a second side regulating member and a second regulating portion configured to regulate a movement of the second regulating member and a second release portion configured to release the regulation of the second side regulating member by the second regulating portion.

4. The feeding device according to claim 3, wherein the second release portion includes an operation portion disposed in the second positioning unit and capable of being operated by a user.

5. The feeding device according to claim 1, further comprising:

a click member disposed in the first positioning unit; and a click groove disposed in the frame member and configured to engage with the click member.

6. The feeding device according to claim 1, further comprising a movement portion configured to move the second positioning unit, which has been moved in an insertion direction of the feeding cassette, in a pullout direction of the feeding cassette.

7. The feeding device according to claim 1, further comprising a brake portion provided on the first positioning unit and configured to serve as a resistance to a movement of the first positioning unit in the first direction and the second direction.

8. A feeding cassette capable of being inserted in and pulled out from a main body of an apparatus, the feeding cassette comprising:

a stacking portion on which a sheet is to be stacked;

a first positioning unit, which is disposed movably in an insertion direction and a pullout direction of the feeding cassette and is in contact with an edge portion of the sheet stacked on the stacking portion, configured to regulate a position of the sheet;

a second positioning unit, which is disposed more on a front side than the first positioning portion in the insertion direction of the feeding cassette, is disposed movably in the insertion direction and the pullout direction of the feeding cassette, and is in contact with an edge portion of the sheet stacked on the stacking portion, configured to regulate the position of the sheet;

a movement portion configured to move the second positioning portion; and a frame member configured to movably hold the first positioning unit and the second positioning unit, wherein the movement portion includes a rack gear disposed in the frame member, and a return gear disposed in the second positioning unit and configured to engage with the rack gear to rotate in such a way to move the second positioning unit, which has been moved in the insertion direction of the feeding cassette, in the pullout direction of the feeding cassette.

9. The feeding cassette according to claim 8, wherein the movement portion includes a sliding gear engaging with the rack gear and pushed against the return gear.

10. The feeding cassette according to claim 8, further comprising a sheet pressing portion provided on the second positioning unit and configured to press the edge portion of the sheet against the side of the first positioning unit.

11. The feeding cassette according to claim 10, wherein a movable distance of the pressing portion is larger than a distance by which the movement portion moves the second positioning unit.

12. The feeding device according to claim 1, wherein a first release portion is provided on the engaging member and configured to release the lock of the first side regulating member locked by the locking member.

13. The feeding device according to claim 1, wherein the lock of the first side regulating member locked by the locking member is released and the engaging portion engages the first side regulating member by the engaging member moving in conjunction with the second positioning unit.

* * * * *